US006071068A

United States Patent [19]

Smith et al.

[11] Patent Number: 6,071,068

[45] Date of Patent: Jun. 6, 2000

[54] DRAGLINE BUCKET TRANSPORTER AND METHOD OF USE

[75] Inventors: Francis V. Smith, Bozeman, Mont.; Harold W. Spielman, Abbotsford, Canada

[73] Assignee: Towhaul Corporation, Bozeman, Mont.

[21] Appl. No.: 09/339,961

[22] Filed: Jun. 25, 1999

Related U.S. Application Data

[62] Division of application No. 08/946,165, Oct. 7, 1997, Pat. No. 5,944,471.

[51] Int. Cl.[7] ..... B60P 1/34

[52] U.S. Cl. ..... 414/800

[58] Field of Search ..... 414/458, 461, 414/471, 481, 482, 483, 679, 495, 800

[56] References Cited

U.S. PATENT DOCUMENTS

| | | | |
|---|---|---|---|
| 2,936,088 | 10/1960 | Andersen | 414/461 |
| 3,468,440 | 9/1969 | Poole | 414/458 |
| 4,049,143 | 9/1977 | Hatakka et al. | 414/471 |
| 4,061,359 | 12/1977 | Metcalfe et al. | 414/458 |
| 4,423,885 | 1/1984 | Camey et al. | 414/481 |
| 4,472,100 | 9/1984 | Wagner | 414/481 |
| 4,640,496 | 2/1987 | Van Hoomissen et al. . | |
| 4,689,904 | 9/1987 | Briscoe . | |
| 4,791,738 | 12/1988 | Briscoe . | |
| 4,864,747 | 9/1989 | Martin et al. . | |
| 5,084,990 | 2/1992 | Briscoe . | |
| 5,140,761 | 8/1992 | Coffman et al. . | |
| 5,400,530 | 3/1995 | Schmidt . | |
| 5,435,586 | 7/1995 | Smith . | |
| 5,575,092 | 11/1996 | Smit . | |

*Primary Examiner*—Robert P. Olszewski
*Assistant Examiner*—Isobel A. Parker
*Attorney, Agent, or Firm*—Clark & Brody

[57] ABSTRACT

A dragline bucket transporter for use in moving a dragline bucket with a hauling vehicle comprises a wheeled trailer having a U-shaped frame with tire-supported free ends, the free ends forming an open end. The frame is moved by a hauling vehicle to surround the sidewalls of a dragline bucket. Once the bucket is surrounded, a cross member of the frame engages and lifts a front end portion of the bucket by action of a hitching assembly attached to the hauling vehicle. With the front end of the bucket elevated, lifting assemblies located at the free ends of the frame lift up a rear portion of the bucket so that it is off the ground. The hauling vehicle can then transport the bucket to a desired location, the bucket then removed from the transporter for use with a dragline.

10 Claims, 6 Drawing Sheets

DRAGLINE BUCKET TRANSPORTER AND METHOD OF USE

This application is a divisional of U.S. patent application Ser. No. 08/946,165, filed on Oct. 7, 1997 now U.S. Pat. No. 5,944,471.

FIELD OF THE INVENTION

The present invention is directed to a dragline bucket transporter and its method of use, and in particular, to a wheeled trailer designed to lift and carry a dragline bucket in conjunction with a hauling vehicle.

BACKGROUND ART

In the prior art, the use of draglines wielding dragline buckets for excavating sites is well known. One example of their use is the removal of the overburden in open pit coal mines. Typically, the buckets have an enormous capacity and can weigh 60 or 80 tons. FIG. 1 shows a typical bucket which is designated by the reference numeral 10. The dragline bucket 10 includes sidewalls 11 connected at the bucket front end by an arch 12 and a bottom 13 terminating in a row of excavating teeth 14. The sidewalls 11 also include shackles 15 to which drag chains (not shown) are connected and trunnions 17 to which hoist chains (not shown) are connected. Since these buckets are conventional, a further description of the bucket structure or its use with a dragline is not deemed necessary for understanding of the invention.

One major problem with these buckets is the difficulty in moving the bucket from one location to another. Often times, the buckets must be moved between sites which are remote from each other and it is impractical for the dragline to accomplish such a task. In these instances, the buckets are often times merely dragged to the next site or placed on steel and the steel is dragged. This type of transport is inefficient since the bucket can not be dragged at any appreciable speed. In addition, the shear weight of the bucket, e.g., 120,000–160,000 pounds, can cause severe damage to the soil or landscape during the dragging process.

Dragline buckets can also be loaded directly on a trailer using the dragline itself. The problem with this loading technique is the difficulty in controlling the dragline bucket during trailer loading. The long lines of the dragline which support the bucket tend to swing the bucket. Consequently, there exists a substantial risk of damaging the trailer via contact with a swinging bucket.

In view of the inability to easily and efficiently move a dragline bucket from one site to another, a need has developed to provide an improved means of transporting a dragline bucket, one that is relatively quick and that does not harm the landscape.

In response to this need, the present invention provides a dragline bucket transporter and method of use which overcomes the disadvantages noted above. The invention is particularly adapted for use with a towing or hauling vehicle as disclosed in U.S. Pat. No. 5,435,586 to Smith that is hereby incorporated in its entirety by reference. Referring to FIGS. 2 and 3, the hitch assembly of the hauling vehicle disclosed in the Smith patent is designated by the reference 20 and includes a gooseneck 21, a tow-hitch assembly 23 and a grab hook assembly 25.

The tow-hitch assembly includes a tow-hitch 27, a post 28 extending from its distal end and a pivot pin 29. The tow-hitch 27 is raised and/or lowered by a hydraulic cylinder 31 and piston 33. Movement of the piston 33 drives the tow-hitch 27 about the pivot pin 29. The cylinder 31, although not shown, is fixed to the towing vehicle (also not shown).

The grab hook assembly 25 includes a grab hook 35 also pivotally mounted on the pin 29. The grab hook 35 is driven by a cylinder 37 and a piston 39, the cylinder 37 being pivotally mounted at 41.

The gooseneck 21 has a hook 43 at its distal end, the hook 43 including a concave surface 45. In conjunction with the surface 45 is a recess 47 in the base of the tow-hitch 27.

Still with reference to FIG. 2, the hitching assembly 20 is shown in combination with the end 50 of a low boy trailer. The trailer end 50 has a coupling 51, the coupling including a shaft 53 for engagement with the hook 43 of the gooseneck 21.

The trailer end 50 also has an upper surface 55 and a lower surface 57 which form a wedge-shape, the inclined upper surface 55 configured to interface with the base of the tow-hitch 27 when it is lowered for lifting purposes. The shaft 53 has spaces on either side to accommodate both the hook 43 and the grab hook 35.

In use, the hauling vehicle, having the hitching assembly 20 attached thereto, moves toward the low boy trailer end 50. During this movement, the hook 43 of the gooseneck 21 is positioned beneath the shaft 53. If misalignment occurs, the grab hook 35 can be operated to pull the shaft 53 onto the concave surface 45. The tow-hitch 27 is then lowered by extension of the piston 33, see FIG. 3, so that the tow-hitch 27 mates with the surface 55 of the trailer end. The tow-hitch force upon the trailer surface 55 causes the low boy trailer end 50 to raise. A lever action occurs at the pivoting point of the gooseneck where it is attached to the vehicle since the cylinder 31 is fixed to the hauling vehicle.

While the Smith patent suggests that a hauling vehicle with the hitching assembly 20 can be used to tow low boy trailers or other vehicles, there is no teaching or suggestion in this patent concerning moving dragline buckets or using the hauling vehicle for such movement.

SUMMARY OF THE INVENTION

Accordingly, it is a first object of the present invention to provide a dragline bucket transporter that permits movement of a dragline bucket by a hauling vehicle.

Another object of the present invention is a method of moving a dragline bucket without the need for a crane.

A still further object of the present invention is to provide a dragline bucket transporter adapted to interface with a hauling vehicle using a gooseneck attachment lifting assembly.

Another object of the present invention is to provide a rapid method of moving a dragline bucket to and from work sites.

Other objects and advantages of the present invention will become apparent as a description thereof proceeds.

In satisfaction of the foregoing objects and advantages, the present invention provides a dragline bucket transporter for use in moving a dragline bucket with a hauling vehicle rather than a crane or the like. The dragline bucket transporter comprises a wheeled trailer having a U-shaped frame with an open end, the open end sized to receive the dragline bucket. The U-shaped frame has a coupling located opposite the open end for attaching the frame to a hauling vehicle. A lifting assembly for lifting a portion of the dragline bucket is located at free ends of the U-shaped frame, a portion of the lifting assembly spanning a space between the free ends of the U-shaped frame. A tire is mounted adjacent each free end of the U-shaped frame, the tires providing rolling support for positioning the frame and to move the dragline bucket once the it is completely lifted off the ground.

In a preferred embodiment, the lifting assembly comprises a cable and a pair of pivoting lifters, each lifter mounted adjacent a respective free end of the U-shaped frame. The cable is sized in length to extend between and attach to the lifters and to also extend beneath a dragline bucket when the dragline bucket is positioned between the free ends. Pivoting movement of each lifter between a first position and a second position causes the cable to vertically rise for dragline bucket lifting. The pivoting lifters can be hydraulically driven, for example, by the hauling vehicle. The lifters can include arms which are pivotally attached thereto to facilitate linking with the cable.

The U-shaped frame can include a cross member and a pair of side members, each preferably having a steel construction. Free ends of the side members form the open end of the trailer with the cross member extending between one end of each of the side members and including the coupling. The cross member upper surface can be angled with respect to horizontal when the cross member is unsupported by a vehicle. With this configuration, the tow-hitch of a hauling vehicle can interface with the upper surface of the cross member for lifting purposes. The cross member is also adapted to support one end of the dragline bucket, e.g., the shackles, when it is positioned between the side members.

The coupling of the U-shaped frame can be any type that will interface with a given hauling vehicle. Preferably, the coupling is a cylindrical shaft which is configured to engage a hook of the hauling vehicle. Other configurations such as an opening to receive a post of a hauling vehicle can also be employed.

The dragline bucket transporter is especially adapted for hauling vehicles using one of the gooseneck attachments described in the Smith patent.

The inventive method entails lifting a dragline bucket with a hauling vehicle and the dragline bucket transporter as described above. First, a dragline bucket is positioned on a ground surface. In conjunction with getting the dragline bucket ready, a hitching assembly of the hauling vehicle is attached to the dragline bucket transporter via the coupling of the U-shaped frame. The U-shaped frame is then positioned by movement of the vehicle so that the dragline bucket is located within the frame for subsequent lifting and transport. With this positioning, a portion of the U-shaped frame, i.e., a lip of the cross member, is arranged beneath a portion of the dragline bucket, e.g., the shackles or other protruding portions at the bucket open end.

The hitching assembly is then raised to lift a front end portion of the dragline bucket off the ground surface. Then, a rear end portion of the dragline bucket is raised off the ground surface with the lifting assembly so that the hauling vehicle can transport the dragline bucket from the ground surface to a desired location. In a preferred mode when using the lifters, the cable is positioned beneath the dragline bucket when partially raised and then connected between the lifters. The lifters are then pivoted to raise the cable and dragline bucket. Once the dragline bucket is moved to its desired location, the method is repeated in reverse order to remove the dragline bucket from the transporter.

BRIEF DESCRIPTION OF THE DRAWINGS

Reference is now made to the drawings of the invention wherein.

DESCRIPTION OF THE PREFERRED EMBODIMENTS

The inventive dragline bucket transporter permits transporting dragline buckets with a hauling vehicle both efficiently and quickly.

Figure 4:
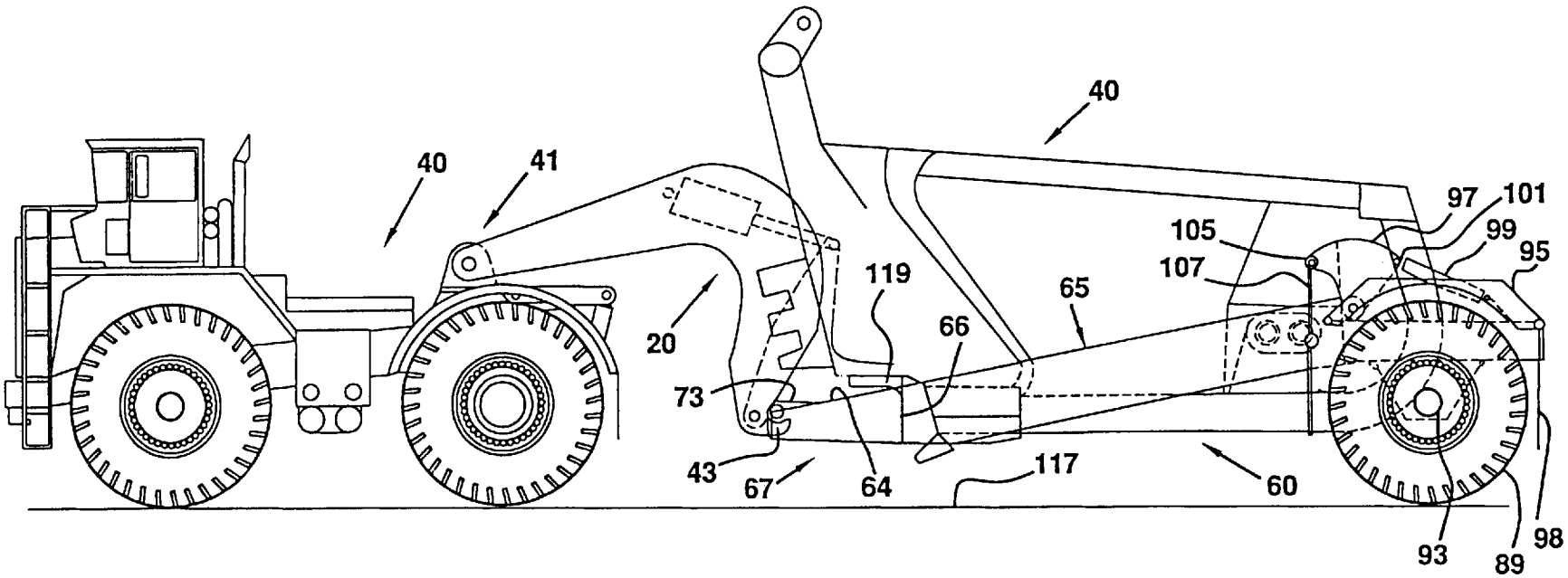
FIG. 4 is a side view of the inventive dragline bucket transporter and a prior art hauling vehicle with a dragline bucket in the raised position.
Figure 5:
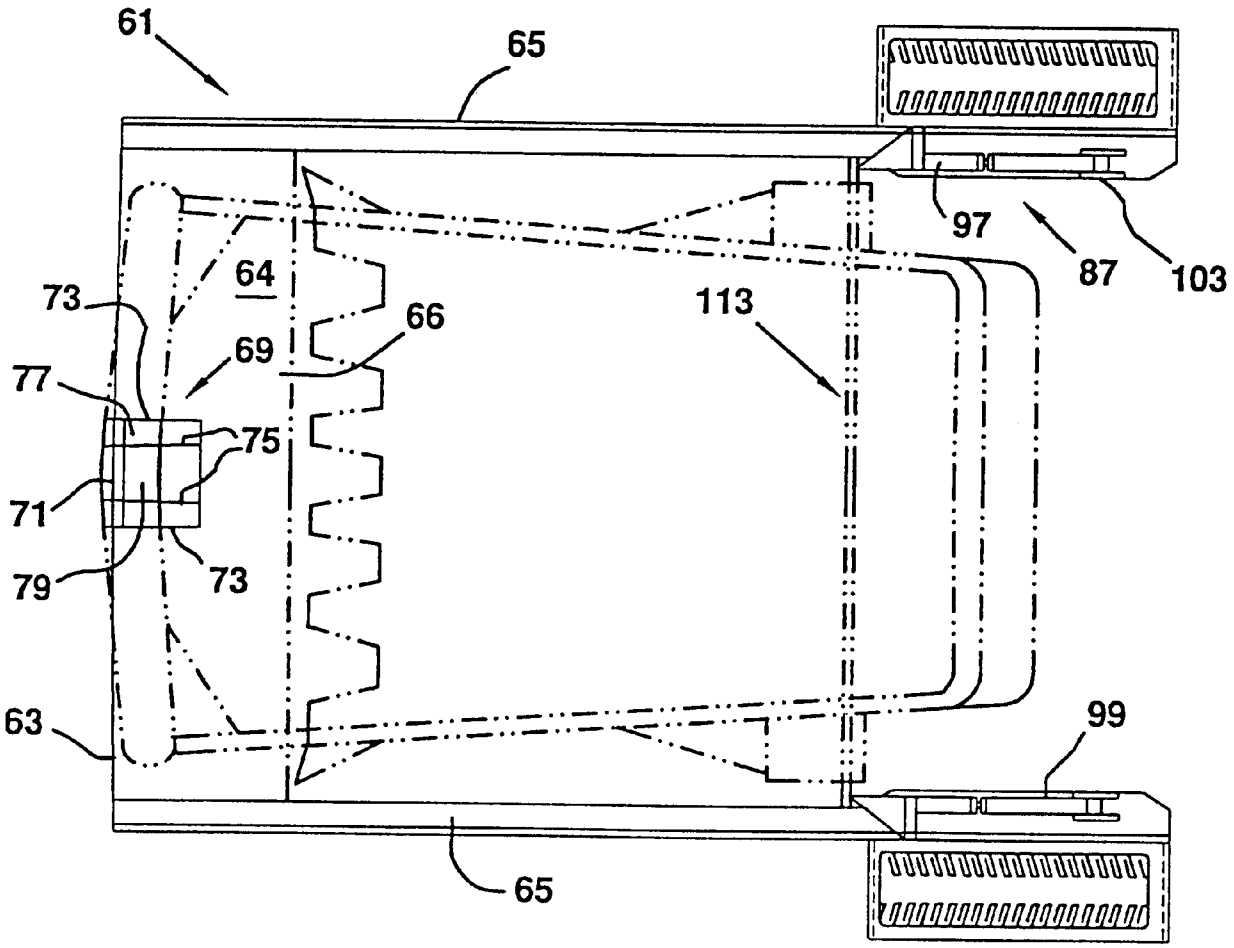
FIG. 5 is a top view of the dragline bucket transporter showing the dragline bucket in phantom.
Figure 6:
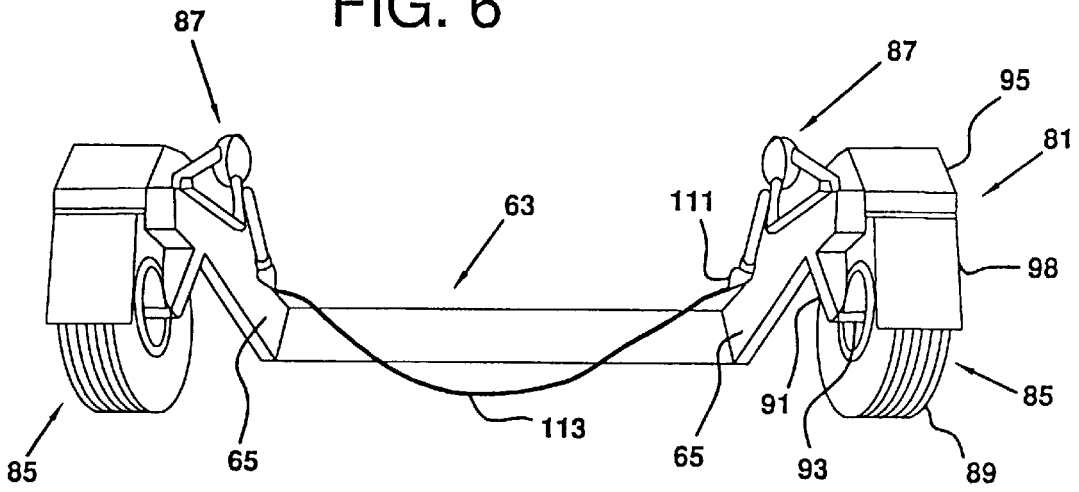
FIG. 6 is an open end perspective view of the dragline bucket transporter.

A preferred embodiment of the inventive bucket transporter is illustrated in FIGS. 4–6. In FIG. 4, the dragline bucket transporter is designated by the reference numeral 60 and is shown supporting a dragline bucket 10 and being linked to the hitching assembly 20 of a hauling vehicle 40. The hauling vehicle 40 and hitching assembly 20 are exemplary and other types of vehicles and/or hitching assemblies can be utilized with the inventive dragline bucket transporter.

The transporter 60 has a U-shaped frame 61, see FIG. 5, which comprises a cross member 63 and side members 65. The cross member 63 has an upper surface 64 which is inclined with respect to horizontal, either in the raised position as shown in FIG. 4 or the lowered position which is similar to that shown in FIG. 2 for the low boy trailer end. When viewed from the side at 67 in FIG. 4, the U-shaped frame 61 is wedge-shaped. The cross member also has a lip 66, see FIG. 4, to support a front end of the dragline bucket 10.

The cross member 63 has a coupling 69 which facilitates the attachment of the cross member 63 to the hitching assembly 20. In the embodiment depicted in FIG. 5, the coupling comprises a shaft 71 which spans two sets of flanges, outer flanges 73 and inner flanges 75. Spaces 77 are formed between the inner and outer flanges as is a central space 79 between the inner flanges 75. The spaces 77 accommodate hooks of the hitching assembly, one shown in FIG. 4. The central space 79 accommodates the grab hook 35. Of course, other types of couplings and/or hitching assemblies can be utilized for lifting and towing of the U-shaped frame 61.

Free ends of the side members 65 includes tire assemblies 85 and lifting assemblies 87, see FIG. 6. Each tire assembly 85 includes a tire 89, a mounting flange 91 extending from the side member 65 and an axle 93. The axle 93 is spaced from the side member 65 so that the side member 65 is angled with respect to horizontal and/or grade or a ground surface. The tire assemblies 85 provide wheel support for the dragline bucket transporter when it being positioned to lift a dragline bucket and also when the dragline bucket is being moved. Preferably, the tires 89 are sized to match the tires of the hauling vehicle 40, see FIG. 4, to minimize inventory and ease their replacement and/or repair.

The tire assembly 85 can also include a wheel well 95 covering an upper portion of the tire 89 and a mud flap 98 extending downwardly from an end of the wheel well 95.

Figure 7:
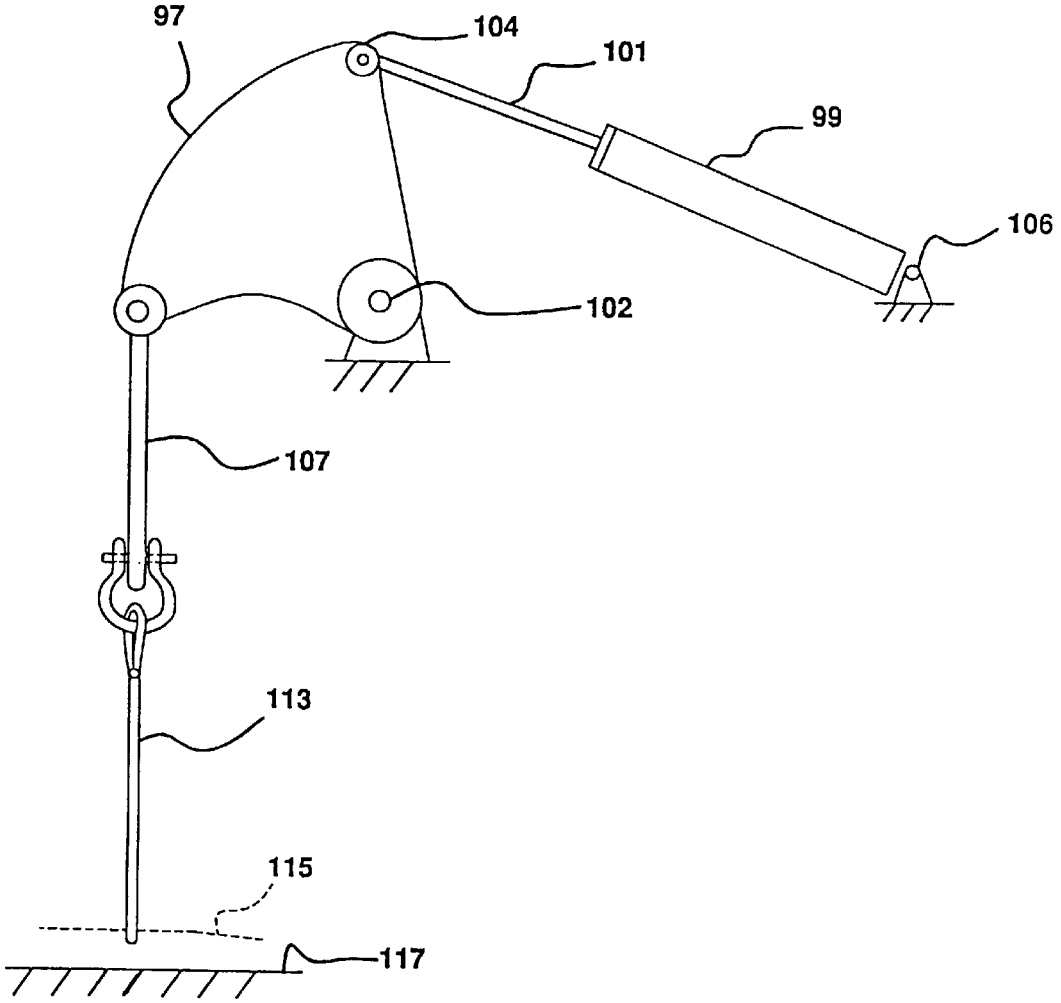
FIGS. 7 and 8 are schematic views of the lifting assembly of the dragline bucket transporter showing inoperative and operative positions.
Figure 8:
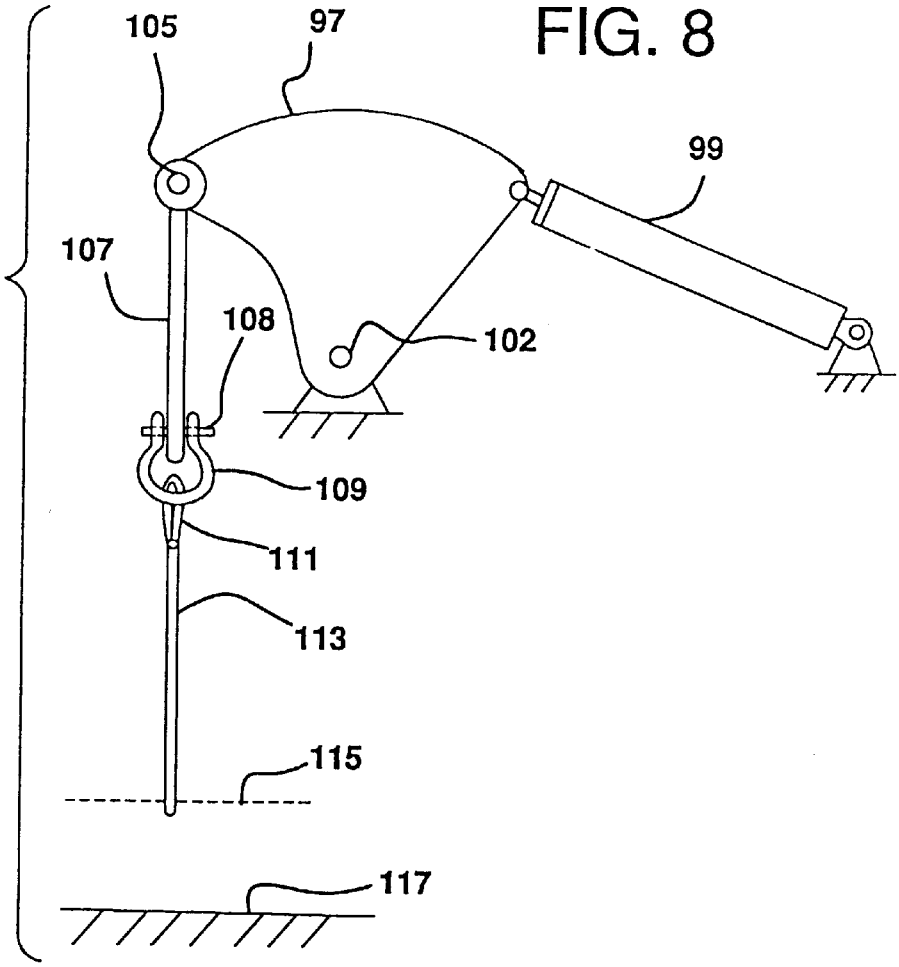

With reference to FIGS. 5, 7 and 8, a lifting assembly 87 is located on each free end of each side member 65. Each lifting assembly 87 includes a lifter 97, a hydraulically driven cylinder 99 and piston 101. The lifter 97 is pivotally mounted to the side member 65 at 102. The piston 101 is mounted to the lifter 97 at 104 and the cylinder 99 is pivotally mounted to the side member 65 at 106, see FIG. 7.

A free end of the lifter has an arm 107 mounted at 105. The mounting at 105 can be any type that will let the arm 107 swing freely or pivot thereabout. At the opposite end of the arm 107 is a connector 109 held in place by a removable pin 108. The connector 109 facilitates attachment to the loop 111 of the lifting cable 113. The pin 108 can be easily removed (cotter pins or the like) so that the loop 111 can be slid off of the connector 109 to disengage the lifting cable 113 during raising and lowering a dragline bucket for transport. The lifting cable 113 spans the distance between the side members as shown in FIG. 6.

Figure 1:
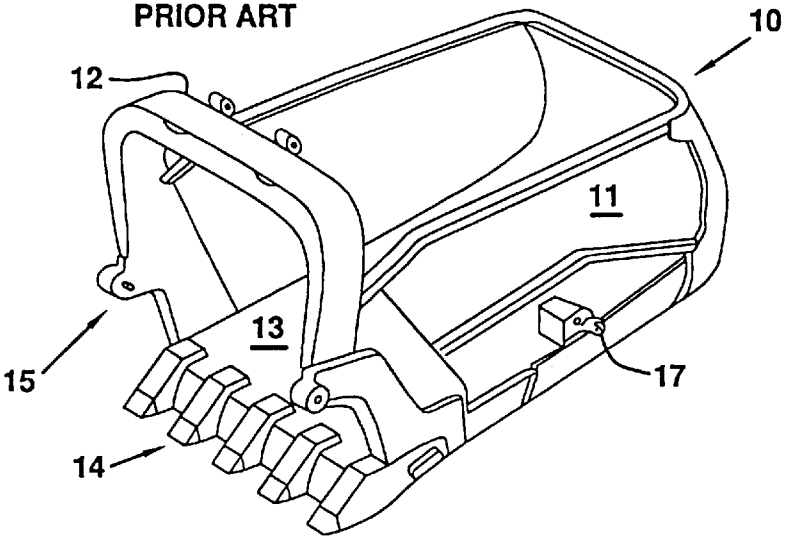
FIG. 1 PRIOR ART
FIG. 1 is representative of a dragline bucket commonly used in the mining industry.
Figure 3:
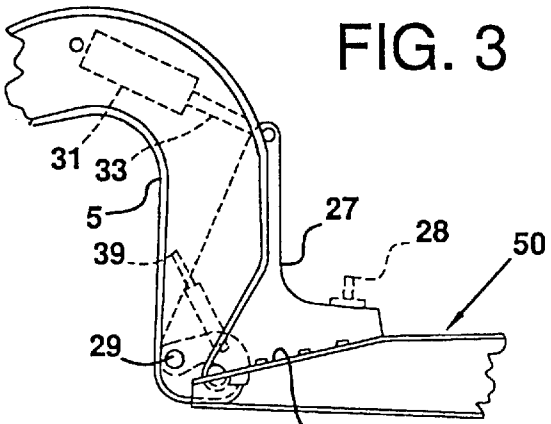
FIG. 3 is a partial side view of the prior art hitching assembly of FIG. 2 in an operative position.
Figure 2:
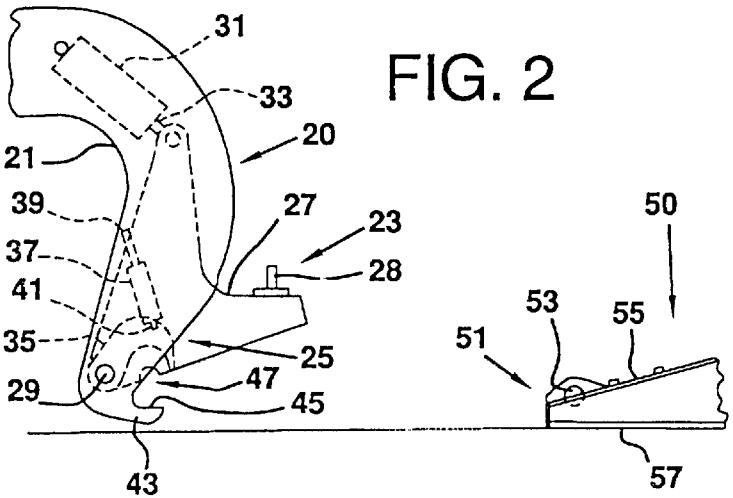
FIG. 2 is a partial side view of a prior art hitching assembly of a hauling vehicle and a trailer in an inoperative position ready for lifting.

The method of using the inventive dragline bucket transporter will now be described. Prior to moving the dragline bucket which rests on a ground surface, the transporter 60 is attached to a hauling vehicle. When using the hitching assembly as depicted in FIG. 2, the method of attaching the coupling 69 to the hitching assembly 20 is similar to that described for FIGS. 2 and 3, thus a further description is not deemed necessary for explaining the method. Other methods of linking a hitching assembly and coupling when using differently configured couplings and hitching assemblies are deemed within the skill of the art. With the transporter 60 attached to the hitching assembly 20, the towing vehicle 40 can then move the transporter 60 so that the side frames 65 are positioned along the sidewalls 11 of the bucket as shown in FIG. 5. As part of this movement, the cross member 63 must be in a position so that the cross member lip 66 can slide beneath the front end portion 119 of the dragline bucket 10 when the bucket is resting on a ground surface. With the lip 66 beneath the front end portion 119, the cross member 63 can then be raised by action of the hitching assembly so that the front end portion 119 of the dragline bucket 10 is supported by the lip 66 and spaced from the ground surface 117.

With the front end of the dragline bucket 10 elevated and the lifter 97 in the position shown in FIG. 7, the bottom 13 of the dragline bucket is slightly angled as represented by the dashed line 115 in FIG. 7. The lifting cable 113 can be slid under the dragline bucket bottom from its elevated front end and the loops 111 can be secured to the connectors 109 so that the lifting cable 113 is securely attached between the two lifters 97. One end of the cable can be secured to one of the connectors 109 prior to sliding the cable beneath the dragline bucket if desired. With the lifting cable 113 in place, the piston 101 can be retracted into the cylinder 99 so that the lifting cable 113 is raised vertically along with the bucket as shown in FIG. 8. The dragline bucket 10 is now in the position shown in FIG. 4 and can be easily transported by the hauling vehicle 40 to a given location.

Once the dragline bucket 10 is moved to a desired location, the process described above can be repeated in reverse order. More specifically, the lifting cable 113 is lowered by action of the piston 101 extending outwardly of the cylinder 99, see FIG. 7. The lifting cable 113 can then be removed from the arms 107.

Then, the cross member 63 of the dragline bucket transporter can be lowered so that the lip 66 disengages from the front end portion 119 and the bucket 10 rests on the ground surface. The hauling vehicle 40 can than pull the dragline bucket transporter from around the dragline bucket 10. The dragline bucket 10 can then be linked to a dragline for excavation.

It should be understood that the exemplified dragline bucket transporter is a preferred embodiment of the invention. For example, the lifting assembly 87 could have other configurations and or mechanisms to raise and lower the dragline bucket once it is positioned within the transporter. For example, rigid J-hooks or other means could be used in place of the lifting cable 113. The lifting assembly could also be powered by other means than hydraulics and be located at different sites on the transporter frame. When using a cable, an 1¼" steel cable is preferred but other types of flexible means such as chain links or the like could be used.

Figure 9:
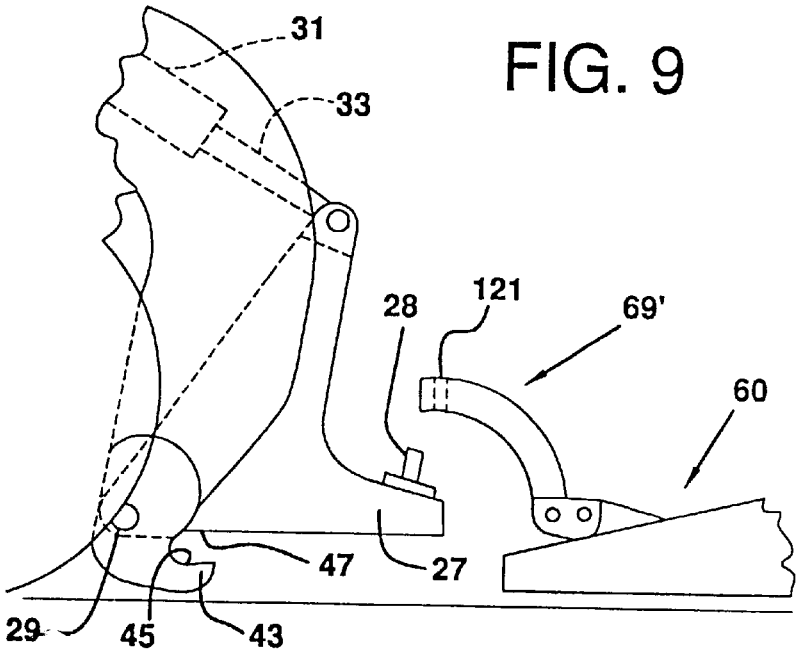
FIG. 9 is a partial side view of an alternative coupling embodiment of the invention.

Similarly, the coupling 69 shown in FIG. 5 can be replaced with other types of couplings. Referring now to FIG. 9, a coupling 69' is illustrated having an opening 121 sized to receive the post 28 of the tow-hitch 27. With this coupling, the post 28 engages the opening 121 and the gooseneck 21 or tow-hitch 27 is raised to lift the transporter 60. Still, other couplings and hitching assemblies can be utilized as would be within the skill of the art.

Figure 10:
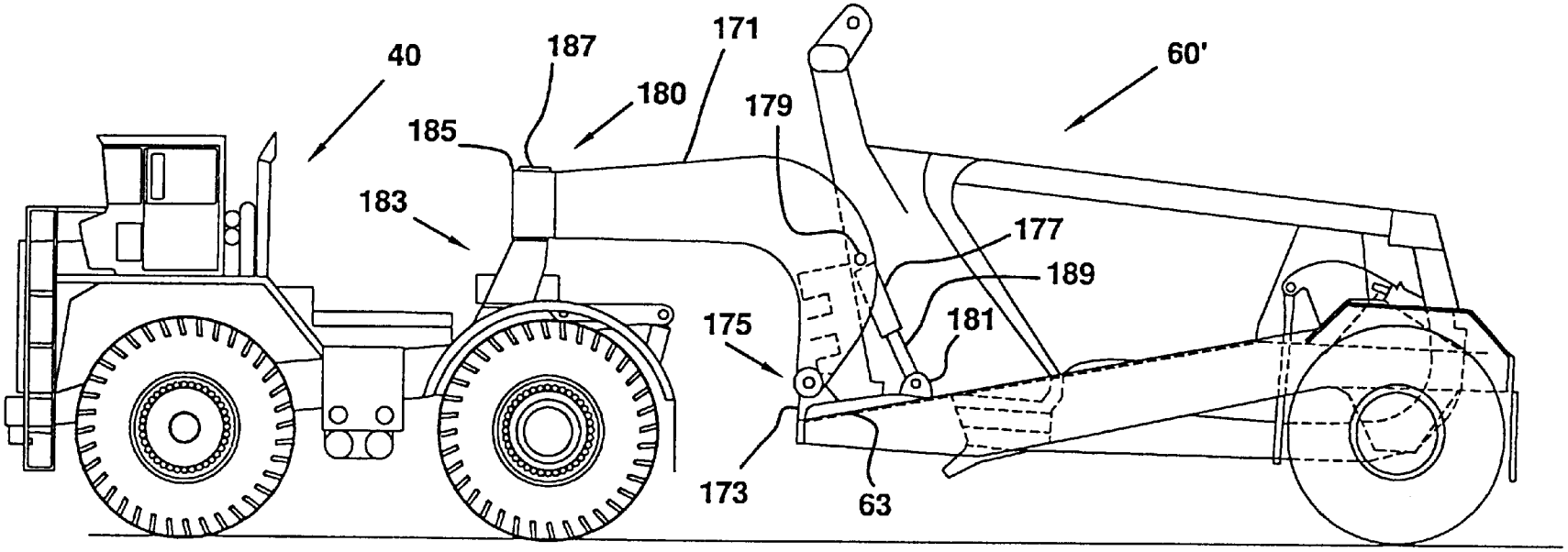
FIG. 10 is a partial side view of another alternative coupling embodiment of the invention.

In yet another coupling embodiment, the transporter 60 can have its own gooseneck which can then be secured to a hauling vehicle. Referring to FIG. 10, a transporter with a gooseneck is designated by the reference numeral 60' and includes a gooseneck 171 which extends from the cross member 63. The gooseneck 171 is secured to the frame in a non-removable manner wherein a mount 173 is welded or otherwise attached to the cross member 63. The gooseneck 171 is linked to the mount 173 via a pivot connection 175. Of course, the gooseneck 171 can be secured to the cross member in any other known or contemplated fashion, e.g., mechanical fastening, welding and mechanical fastening in combination or the like.

The pivot connection 175 functions in combination with at least one cylinder 177 which is linked at 179 to the gooseneck 171 and at 181 to the cross member 63. Operation of the cylinder, which can be hydraulically driven, pivots the gooseneck 171 about its pivot connections as described below during transporter use.

The gooseneck 171 has a free end 180 which is adapted to connect to a hauling vehicle hitching assembly 183. In FIG. 10, the free end 180 is configured with an opening 185 sized to receive a post 187 of the assembly 183. With this attachment, the gooseneck 171 can swivel about post 187 as well as pivot either clockwise or counterclockwise, similar to the pivoting action of the gooseneck 5, see FIGS. 2 and 3. Of course, other types of connections can be made between the gooseneck 171 and the hauling vehicle 40, e.g., either by a coupling type connector at the free end or a shape configuration which will permit the free end to directly and pivotally attach to a hitching assembly of a hauling vehicle. For example, the gooseneck 171 can be configured with a slotted end to attach to a hitching assembly similar to the assembly 41 of the hauling vehicle 40 as shown in FIG. 4. With the gooseneck made part of the transporter 60', other types of hauling vehicles could be employed for transporter hauling, e.g., over the road types or the like since the free end 173 of the gooseneck 171 can be configured to attach to conventional or standard hitching assemblies of hauling vehicles.

In use, the transporter 60' is first connected to the hauling vehicle so that the hauling vehicle is typically used for bucket transport only. In other words, the gooseneck remains linked to the hauling vehicle. This contrasts with the hauling vehicle 40 having the hitching assembly 20 that is designed for other purposes than just dragline bucket transport. Since the assembly 20 may be required to haul a 300 ton trailer, it uses a much heavier duty gooseneck than the gooseneck 171. Consequently, the cylinder(s) 177 does not have to be a large as the cylinder(s) used in the assembly 20.

Once the gooseneck is fixed to the post 187, the cross member 63 of the transporter 60' is lowered to pick up the dragline bucket 10. Referring to FIG. 10, the cylinder is shown with its piston 189 in an extended position. Retracting the piston causes the gooseneck to pivot clockwise about the pivot connection 175 and the assembly 183, which in turn lowers the transport 60' (the transporter 60' pivots counterclockwise about the tire axes) so that the lip 66 of the cross member 63 can be positioned beneath the dragline bucket. Driving the piston 189 so that it extends from the cylinder 177 causes counterclockwise movement of the gooseneck about the pivot connection 175 and assembly 183 (clockwise movement of the transporter 60') for raising the cross member 63 and dragline bucket 10. The dragline bucket can then be transported to its desired location with reversal of the steps described above for cross member lowering, bucket unloading and cross member raising to move the transporter 60' to another location for transport of another bucket.

The transporter 60 is preferably made of a high strength steel, e.g., a T-1 steel, since it is required to support dragline buckets of significant weight, e.g., 60 to more than 150 tons. The cross member and side members can have any configuration, channel-like, tubular or the like, providing that adequate strength is achieved to support the intended loads.

The tire assemblies can also vary. For example, two tires for each free end of the side member could be utilized for extremely large capacity dragline buckets. Other axle configurations can be utilized as would be within the skill of art.

As such, an invention has been disclosed in terms of preferred embodiments thereof which fulfill each and every one of the objects of the present invention as set forth above and provides a new dragline bucket transporter and a method of use.

Of course, various changes, modifications and alterations from the teachings of the present invention may be contemplated by those skilled in the art without departing from the intended spirit and scope thereof. It is intended that the present invention only be limited by the terms of the appended claims.

What is claimed is:

1. A method of lifting a dragline bucket with a hauling vehicle comprising the steps of:

a) providing a dragline bucket transporter which comprises:

i) a U-shaped frame having an open end, the open end sized to receive a dragline bucket;

ii) a coupling located on the U-shaped frame opposite the open end;

iii) a lifting assembly located at free ends of the U-shaped frame, a portion of the lifting assembly spanning a space between the free ends of the U-shaped frame; and iv) a tire mounted adjacent each free end of the U-shaped frame;

b) providing a dragline bucket on a ground surface;

c) providing a hauling vehicle and attaching a hitching assembly of the hauling vehicle via the coupling to the U-shaped frame;

d) positioning the U-shaped frame around the dragline bucket so that a portion of the U-shaped frame is positioned beneath a portion of the dragline bucket;

e) raising the hitching assembly to lift a front end portion of the dragline bucket off the ground surface; and f) raising a rear end portion of the dragline bucket off the ground surface with the lifting assembly so that the hauling vehicle can transport the dragline bucket from the ground surface to a desired location.

2. The method of claim 1, wherein the lifting assembly further comprises a cable and a pair of pivoting lifters, each lifter mounted adjacent a respective free end of the U-shaped frame, the cable sized in length to extend between and attach to the lifters and to extend beneath the rear end of the dragline bucket when the dragline bucket is positioned between the free ends, and after step (e), attaching the cable ends to respective lifters and pivoting the lifters to vertically raise the cable to lift said rear end portion.

3. The method of claim 1, wherein the coupling of the U-shaped frame is a shaft and the hitching assembly of the hauling vehicle is a gooseneck ending in a hook, and wherein step (c) further comprises engaging the hook with the shaft for the positioning of step (d).

4. The method of claim 1, wherein the coupling of the U-shaped frame is an opening and the hitching assembly of the hauling vehicle is a gooseneck ending in a post, and wherein step (c) further comprises engaging the post with the opening for the positioning of step (d).

5. The method of claim 1, wherein the U-shaped frame has a cross member with an upper surface angled with respect to horizontal when the portion of the U-shaped frame is positioned beneath the front end portion of the dragline bucket, and the hauling vehicle has a pivoting tow hitch, the tow hitch pivoted downwardly to engage the upper surface of the cross member to secure the shaft in the hook.

6. The method of claim 1, wherein the coupling is a gooseneck attachment assembly with a pivotal connection attached to the U-shaped frame and a free end opposite the attachment to the U-shaped frame, and step (c) comprises attaching the free end of the gooseneck attachment assembly to the hitching assembly of the hauling vehicle.

7. A method of lifting a dragline bucket comprising the steps of:

a) raising a first end of the dragline bucket above a ground surface with a forward end of a u-shaped bucket transporter to create a clearance between the raised end of the dragline bucket and an opposite end of the dragline bucket resting on the ground surface;

b) inserting a flexible member in the clearance to span an underside of the dragline bucket, the flexible member linked to the u-shaped bucket transporter; and c) raising the opposite end of the dragline bucket using the flexible member so that the u-shaped bucket transporter supports the dragline bucket off the ground surface.

8. The method of claim 7, wherein the dragline bucket is lowered onto a ground surface by first lowering the opposite end using the flexible member, and then lowering the first end using the u-shaped bucket transporter.

9. The method of claim 7, wherein the u-shaped bucket transporter is hauled by a towing vehicle to move the dragline bucket from a first location to a second location.

10. The method of claim 9, wherein the dragline bucket is lowered onto a ground surface by first lowering the opposite end using the flexible member, and then lowering the first end using the u-shaped bucket transporter after the dragline bucket is moved to the second location.

* * * * *